US005716224A

United States Patent [19]

Masuda et al.

[11] Patent Number: 5,716,224

[45] Date of Patent: Feb. 10, 1998

[54] CONNECTOR WITH SHUTTER MECHANISM

[75] Inventors: Satoki Masuda; Toshiaki Hasegawa; Shigemitsu Inaba, all of Shizuoka, Japan

[73] Assignee: Yazaki Corporation, Tokyo, Japan

[21] Appl. No.: 556,088

[22] Filed: Nov. 9, 1995

[30] Foreign Application Priority Data

Nov. 10, 1994 [JP] Japan ..... 6-276710

[51] Int. Cl.[6] ..... H01R 13/44

[52] U.S. Cl. ..... 439/138

[58] Field of Search ..... 439/138, 142

[56] References Cited

U.S. PATENT DOCUMENTS 4,176,897 12/1979 Cameron ..... 439/138

5,372,515 12/1994 Miller et al. ..... 439/138

FOREIGN PATENT DOCUMENTS 0232792 8/1987 European Pat. Off. ..... 439/138

424275 2/1992 Japan ..... H01R 13/52

*Primary Examiner*—Neil Abrams

*Assistant Examiner*—T. C. Patel

*Attorney, Agent, or Firm*—Sughrue, Mion, Zinn, Macpeak & Seas, PLLC

[57] ABSTRACT

A connector includes a first connector and a second connector which are fitted to each other to be electrically connected. One of the first and second connectors is provided with shutters each of which is pivotally moved outwardly upon application of an external force to a front surface portion of the respective shutters. The other connector is provided with front end portions, and during the time when the two connectors are fitted together, each of the front end portions urges the front surface portion of the associated shutter.

1 Claim, 7 Drawing Sheets

CONNECTOR WITH SHUTTER MECHANISM

BACKGROUND OF THE INVENTION

The present invention relates to a connector with a shutter mechanism comprising a pair of female and male connectors used for electrical connection purposes.

Wire harnesses (electric wire) for electrically connecting various kinds of electrical parts mounted on an automobile or the like, have heretofore been connected through connectors in order to achieve an improved mounting efficiency. Usually, such a connector comprises a female connector containing a male terminal connected to one end of a wire, and a male connector which is inserted into a fitting hood portion of the female connector and contains a female terminal connected to one end of a wire.

There is also a connector for electrically connecting an electrical part provided according to an optional specification, to a vehicle body. This connector is provided between the electrical part or one end of a wire connected thereto, and one end of a wire which is pre-mounted and is not used in the design of a standard specification.

In such a connector used for the optional specification, there is known a construction in which one of female and male connectors, connected to the end of the pre-mounted wire, is provided with a shutter mechanism which protects against dust, protects the terminal, and prevents an electric shock from being applied to the surroundings until the other connector is connected to the one connector. Particularly in an electric car, there is provided such a connector with a shutter for the purpose of preventing an electric shock accident, and the terminal is prevented from being exposed when the connector is in a non-connected condition. One example of such a construction is disclosed in Japanese Utility Model Unexamined Publication No. Hei. 4-24275, and FIG. 10 is a cross-sectional view showing this connector.

In FIG. 10, a connector 51 comprises a female connector 52 and a male connector 60, and a pair of shutters 53A and 53B are pivotally mounted on the female connector 52 adjacent to a front opening thereof, the shutters 53A and 53B being pivotally movable inwardly. A pair of shutters 63A and 63B are also pivotally mounted on the male connector 60 adjacent to a front opening thereof, the shutters 63A and 63B being pivotally movable inwardly. Stoppers 54A and 54B, formed on the front end of the female connector 52, limit the outward (right in FIG. 10) pivotal movements of the shutters 53A and 53B, respectively. Similarly, stoppers 64A and 64B, formed at the front end of the male connector 60, limit the outward (left in FIG. 10) pivotal movements of the shutters 63A and 63B, respectively.

When the female and male connectors 52 and 60 are not fitted together, the shutters 53A and 53B, as well as the shutters 63A and 63B, are kept closed, and the interior of each connector is closed.

For effecting the fitting, when the male connector 60 is inserted into the female connector 52, the front end of the male connector 60 abuts against the shutters 53A and 53B to pivotally move them inwardly. As a result of this pivotal movement, the closed condition of the female connector 52 is released.

When the male connector 60 is further inserted into the female connector 52, the shutters 53A and 53B are further pivotally moved inwardly, and an opening projection 55, which is provided within the female connector 52, and projects forwardly (right in FIG. 10), abuts against the shutters 63A and 63B of the advancing male connector 60 to be pressed against the front surfaces of these shutters. As a result, the shutters 63A and 63B are pivotally moved inwardly, so that the closed condition of the male connector 60 is released.

Thus, the shutters 53A and 53B, as well as the shutters 63A and 63B, are pivotally moved into the respective connector, so that the male terminal in the female connector is connected to the female terminal in the male connector, and therefore the wire connected to the female terminal are electrically connected to the wire connected to the male terminal.

In the above conventional construction, each connector is provided with the pair of openable shutters, and when an external force acts on these shutters, the shutters are pivotally moved into the connector to be opened. Therefore, if the finger or the like inadvertently contacts the shutter, the shutter is easily opened, so that the finger is inserted into the connector. As a result, the finger is brought into contact with the terminal, which may cause an electrical shock. And besides, the shutters do not have any function to prevent the mistaken intrusion of the fingers or the like, which somewhat poses a problem from the viewpoint of safety.

Furthermore, in the conventional construction, the opening projection is provided within the housing so as to open the shutters of the mating connector, and therefore the overall construction of the connector is increased, thus inviting a problem that it is difficult to achieve a compact design.

SUMMARY OF THE INVENTION

The present invention has been made in order to solve the above problems, and an object of the invention is to provide a connector with a shutter mechanism in which even if the finger or the like is inadvertently inserted into the connector, shutters will not be opened so as to prevent an electric shock, thus securing safety, and a compact design can be achieved.

The above object has been achieved by a connector of the invention with a shutter mechanism comprising a first connector and a second connector which are fitted to each other to be electrically connected; charterized in that one of the first and second connectors is provided with a shutter which is pivotally moved outwardly upon application of an external force to a front surface portion of the shutter; the other connector is provided with a front end portion; and during the time when the two connectors are fitted together, the front end portion urges the front surface portion of the associated shutter.

According to another aspect of the invention, there is provided a connector with a shutter mechanism comprising a first connector and a second connector which are fitted to each other to be electrically connected; charterized in that each of the first and second connectors is provided with a shutter which is pivotally moved outwardly upon application of an external force to a front surface portion of the shutter; one of the first and second connectors is provided with a front end portion; during the time when the two connectors are fitted together, the front end portion urges the front surface portion of the associated shutter of the other connector to pivotally move the shutter, while the pivotally-moving shutter urges the front surface portion of the associated shutter of the one connector to pivotally move the shutter.

Preferably, there is provided a hood portion covering a pivotal-movement drive portion for the shutter.

In the connector of the invention with the shutter mechanism, during the fitting operation, the shutter mounted on the one connector is pivotally moved outwardly to be opened when the shutter is urged by the front end portion of the other connector, so that a terminal, received in the one connector, is exposed so as to be connected to a terminal in the other connector. With this construction, the protection against dust, the protection of the terminal, and the prevention of an electric shock to the surroundings are achieved.

In another form of the invention, during the fitting operation, the shutter mounted on the one connector is pivotally moved outwardly to be opened when the shutter is urged by the front end portion of a housing of the other connector, so that the terminal, received in the one connector, is exposed. At the same time, the shutter thus pivotally moved outwardly urges the front surface portion of the associated shutter of the other connector to pivotally move this associated shutter outwardly, so that the terminal in the other connector is exposed to be connected to the terminal in the one connector. With this construction, the size of the connector in the axial direction is reduced, thus achieving a compact design, and the protection against dust, the protection of the terminals, and the prevention of an electric shock to the surroundings are achieved.

DETAILED DESCRIPTION OF THE INVENTION

Preferred embodiments of the present invention will now be described with reference to the accompanying drawings.

Figure 1:
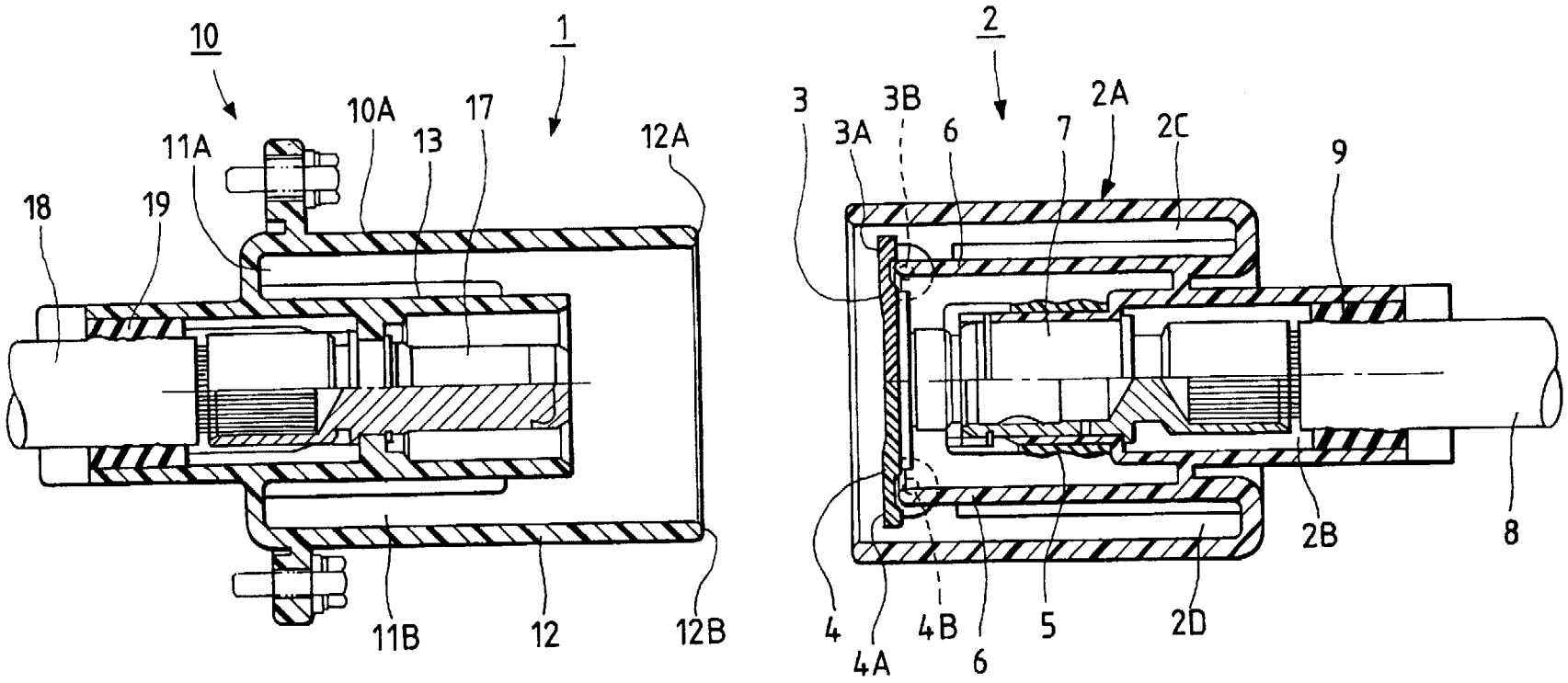
FIG. 1 is a cross-sectional view of a first embodiment of a connector of the invention with a shutter mechanism.

FIG. 1 is a cross-sectional view of a first embodiment of a connector of the invention with a shutter mechanism.

Figure 2:
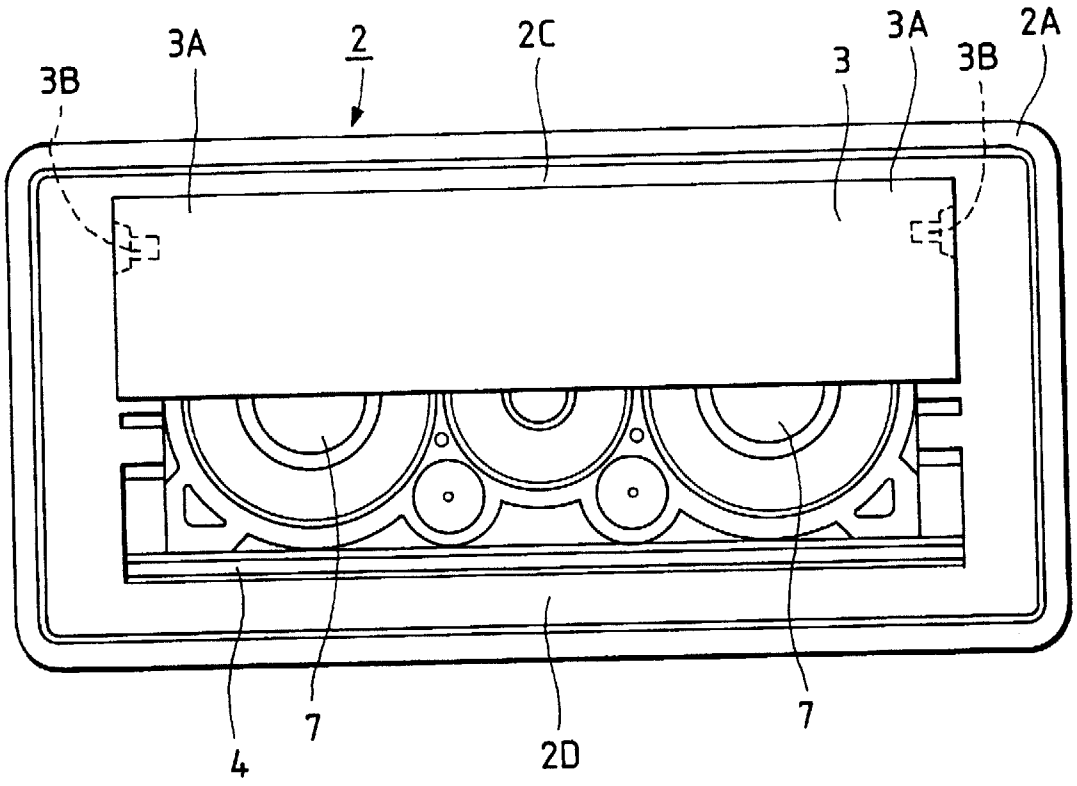
FIG. 2 is a front-elevational view of a first connector of FIG. 1 in its partly-opened condition.

FIG. 2 is a front-elevational view of a first connector in FIG. 1 in its partly-opened condition.

Figure 3:
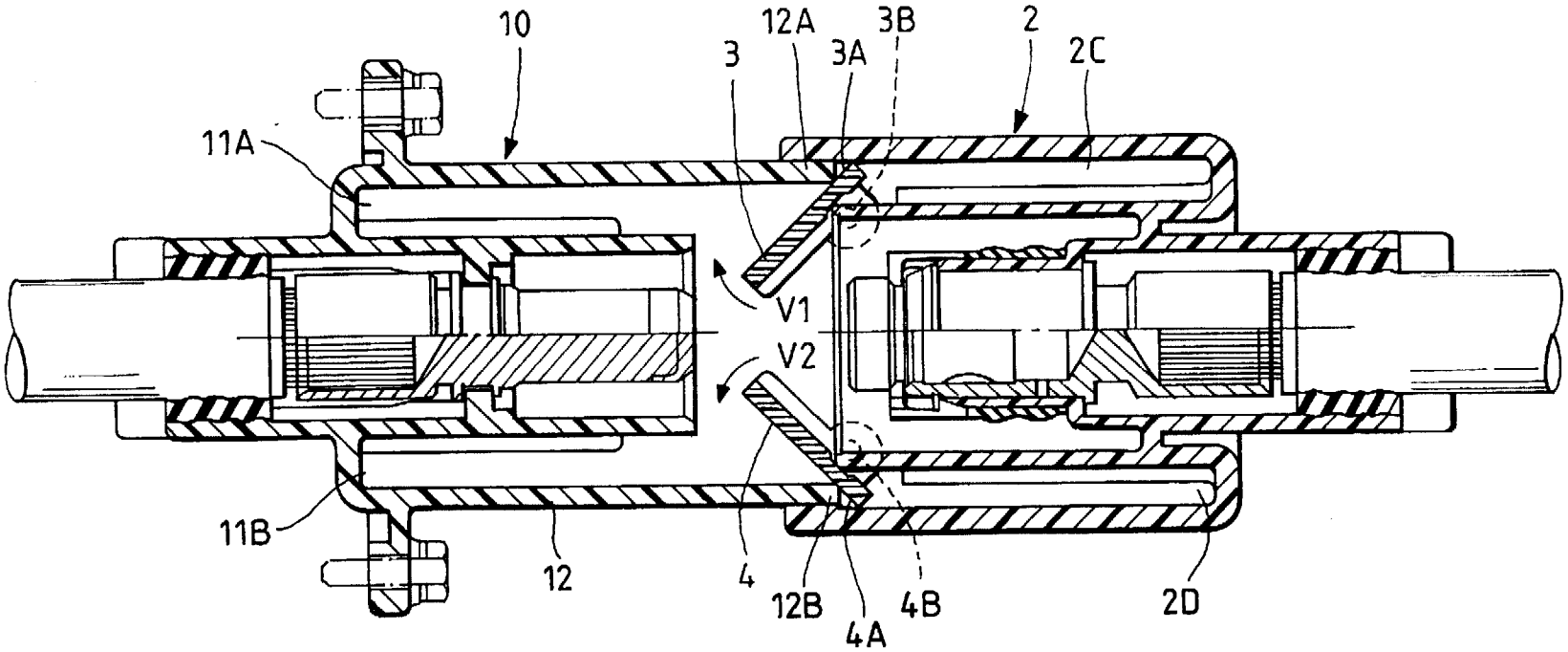
FIG. 3 is a view showing the process of fitting between the first and second connectors of FIG. 1.

FIG. 3 is a view showing the process of fitting between the first and second connectors of FIG. 1.

In FIG. 1, a connector 1 with a shutter mechanism according to the present invention comprises a first connector 2 and a second connector 10 which are fitted together. In this embodiment, the first connector 2 is a male connector having first terminals 7 of the female type attached thereto, while the second connector 10 is a female connector having second terminals 17 of the male type attached thereto, the first terminals 7 being connected to the second terminals 17, respectively.

In FIGS. 1 and 2, the first connector 2 includes a housing 2A of a rectangular parallelepipedic shape, and has a front opening for receiving the mating connector (second connector 10), and a rear opening for receiving the first terminals 7 each connected to a wire 8.

A support hood portion 6 is formed within the housing 2A, and extends toward the front opening. An upper shutter 3 of a rectangular shape is mounted by pins 3B on upper portions of opposite side walls of the support hood portion 6 so as to be pivotally moved outwardly (forwardly). A lower shutter 4 of a rectangular shape is mounted by pins 4B on lower portions of the opposite side walls of the support hood portion 6 so as to be pivotally moved outwardly (forwardly).

The upper and lower shutters 3 and 4 forms a pair, and are normally urged toward the inner side of the housing 2A by coil springs (not shown). These shutters in their closed positions close the first terminals 7. A pivotal movement space for the upper and lower shutters 3 and 4 is provided at a front end portion of the interior of the housing 2A.

Pivotal-movement drive portions for the upper and lower shutters 3 and 4, which include the pins 3B and 4B, are covered by the housing 2A of a hood-like configuration.

An upper end of the front surface of the upper shutter 3 defines a flat front surface portion 3A, and when an external force, directed toward the inner side of the housing 2A, acts on this front surface portion 3A, the upper shutter 3 is pivotally moved outwardly (forwardly) about the pins 3B against the bias of the coil spring. Similarly, a lower end of the front surface of the lower shutter 4 defines a flat front surface portion 4A, and when an external force, directed toward the inner side of the housing 2A, acts on this front surface portion 4A, the lower shutter 4 is pivotally moved outwardly (forwardly) about the pins 4B against the bias of the coil spring.

Terminal receiving chambers 2B are formed at the rear portion of the first connector 2, and the first terminals 7 each having the wire 8 connected thereto are received in these terminal receiving chambers, respectively.

A hood receiving portion 2C for receiving a front end portion 12A of a fitting hood portion 12 of the second connector 10 is formed between the inner surface of the housing 2A and the outer surface of the support hood portion 6, and another hood receiving portion 2D for receiving a front end portion 12B of the fitting hood portion 12 is formed between the inner surface of the housing 2A and the outer surface of the support hood portion 6.

A packing 5 is fitted on a front outer portion of the housing 2A behind which the terminal receiving chamber 2B is formed, and which contacts the first terminal 7 at its inner surface, and an inner surface of a receiving wall 13 (described later) of the second connector 10 is adapted to contact the outer surface of this packing 5 in an air-tight manner.

A waterproof rubber plug 9 is fitted on the wire 8, and is fitted in the rear end of the terminal receiving chamber 2B.

In FIG. 1, the second connector 10 comprises a housing 10A of a rectangular parallelepipedic shape, and the outer peripheral size of the housing 10A is slightly smaller than the inner peripheral size of the housing 2A of the first connector 2, so that the housing 10A can be inserted into the housing 2A of the first connector 2. Second terminals 17 each having a wire 18 connected thereto, are received in the receiving wall 13 formed within the housing 10A.

A waterproof rubber plug 19 is fitted on the wire 18, and is fitted in a rear end of the second connector 10.

The housing 10A has a forwardly-extending, fitting hood portion 12, and when the second connector 10 is fitted into the first connector 2, the upper and lower front end portions 12A and 12B of this fitting hood portion 12 abut respectively against the front surface portion 3A of the upper end of the upper shutter 3 of the first connector 2 and the front surface portion 4A of the lower end of the lower shutter 4.

An upper shutter-receiving groove 11A for receiving the pivotally-moved upper shutter 3 of the first connector 2 is formed between the inner surface of the housing 10A and the receiving wall 13, and also a lower shutter-receiving groove 11B for receiving the pivotally-moved lower shutter 4 is formed between the inner surface of the housing 10A and the receiving wall 13.

The operation of this embodiment will now be described.

When the first and second connectors 2 and 10 are not fitted together, the upper and lower shutters 3 and 4 are closed, so that the first terminals 7 of the first connector 2 are not exposed. Therefore, in the first connector 2, the protection against dust, the protection of the terminals and the prevention of an electric shock to the surroundings are achieved.

In such a condition, the first connector 2 begins to be inserted and fitted into the second connector 10. First, in the condition shown in FIG. 1, the two connectors are moved relative to each other, and the second connector 10 is inserted into the housing 2A of the first connector 2. At this time, the front end portion 12A of the fitting hood portion 12 of the second connector 10 abuts against the front surface portion 3A of the upper end of the upper shutter 3 of the first connector 2 to urge the front surface portion 3A against the bias of the coil spring. Similarly, the front end portion 12B of the fitting hood portion 12 abuts against the front surface portion 4A of the lower end of the lower shutter 4 of the first connector 2 to urge the front surface portion 4A against the bias of the coil spring.

As a result, the pair of shutters 3 and 4 are pivotally moved away from each other about the respective pins 3B and 4B. Namely, the upper shutter 3 is pivotally moved in a direction V1 (clockwise direction in the drawings) whereas the lower shutter 4 is pivotally moved in a direction V2 (counterclockwise direction), so that the first terminals 7 are exposed. Thus, the first connector 2 is opened at its front portion.

The inner surface of the housing 2A of the first connector 2 is held in sliding contact with the outer surface of the fitting hood portion 12 of the second connector 10.

In this condition, the second connector 10 is further moved toward the rear end of the first connector 2, and hence is inserted deeper into the first connector 2, so that the pair of shutters 3 and 4 are pivotally moved into contact with the inner surface of the fitting hood portion 12.

When the second connector 10 is further inserted deeper, the pair of shutters 3 and 4, while kept in contact with the inner surface of the fitting hood portion 12, are inserted respectively into the upper and lower shutter-receiving grooves 11A and 11B in the second connector 10. At this time, the second terminals 17 are connected to the first terminals 7, respectively, so that the wires 18 are electrically connected to the wires 8, respectively.

Also, when the first and second connectors 2 and 10 are thus fitted together, the packing 5 fitted in the first connector 2 is held in firm contact with the inner surface of the receiving wall 13 of the second connector 10. As a result, a water-tight seal is formed between the two connectors.

Thus, in the embodiment, the first connector 2 can be opened and closed by the pair of shutters 3 and 4, and even if external force acts on these shutters 3 and 4, and for example, if the finger or the like is inadvertently inserted into the first connector 2, the shutters 3 and 4 prevents the advance of the finger, since the shutters 3 and 4 can only be opened outwardly (forwardly). Therefore, the finger will not contact the first terminals 7, thus securing safety. The pivotal movement-drive portions for the shutters 3 and 4 are covered by the housing 2A of a hood-like configuration, and therefore these shutters will not be accidentally moved pivotally by contact from the exterior. And besides, even if the finger or the like accidentally presses against the upper end of the shutter 3 or the lower end of the lower shutter 4, the finger is automatically pushed out since the shutters 3 and 4 are opened outwardly (forwardly). Therefore, this construction is quite safe.

In the above embodiment, although there are used the pair of upper and lower shutters which can be opened upwardly and downwardly, respectively, from the center position, the invention is not limited to such a construction. For example, there can be provided a pair of right and left shutters which can be opened right and left, respectively, from the center position.

In the above embodiment, although the shutter is divided into the two portions, the invention is not limited to such a construction, and the shutter may be divided into more than two portions.

Figure 4:
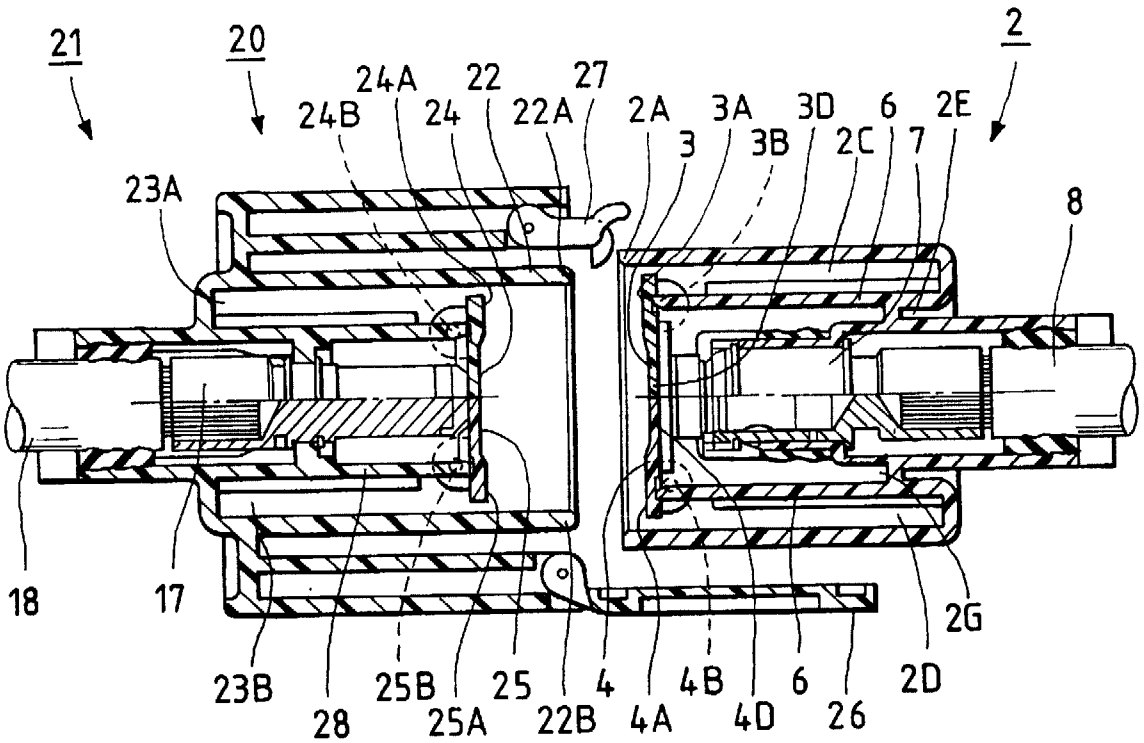
FIG. 4 is a cross-sectional view of a second embodiment of a connector of the invention with a shutter mechanism.

FIG. 4 is a cross-sectional view of a second embodiment of a connector of the invention with a shutter mechanism. In FIG. 4, the connector 20 with the shutter mechanism according to the invention comprises a first connector 2 and a second connector 21 which are fitted together. In this embodiment, the first connector 2 is a male connector having first terminals 7 of the female type attached thereto, while the second connector 21 is a female connector having second terminals 17 of the male type attached thereto, the first terminals 7 being connected to the second terminals 17, respectively. In this embodiment, those portions of the first connector 2 identical to those of the first connector 2 of the first embodiment will be designated by the same reference numerals, respectively, and explanation thereof will be omitted.

A lower end of an upper shutter 3 of the first connector 2 defines a distal end 3D of the upper shutter, and an upper end of a lower shutter 4 defines a distal end 4D of the lower shutter. An upper shutter-receiving groove 2E is formed adjacent to an upper inner surface of a support hood portion 6, and a lower shutter-receiving groove 2G is formed adjacent to a lower inner surface of the support hood portion 6. The upper shutter-receiving groove 2E receives an upper shutter 24 (described later) of the second connector 21, and the lower shutter-receiving groove 2G receives a lower shutter 25.

Figure 5:
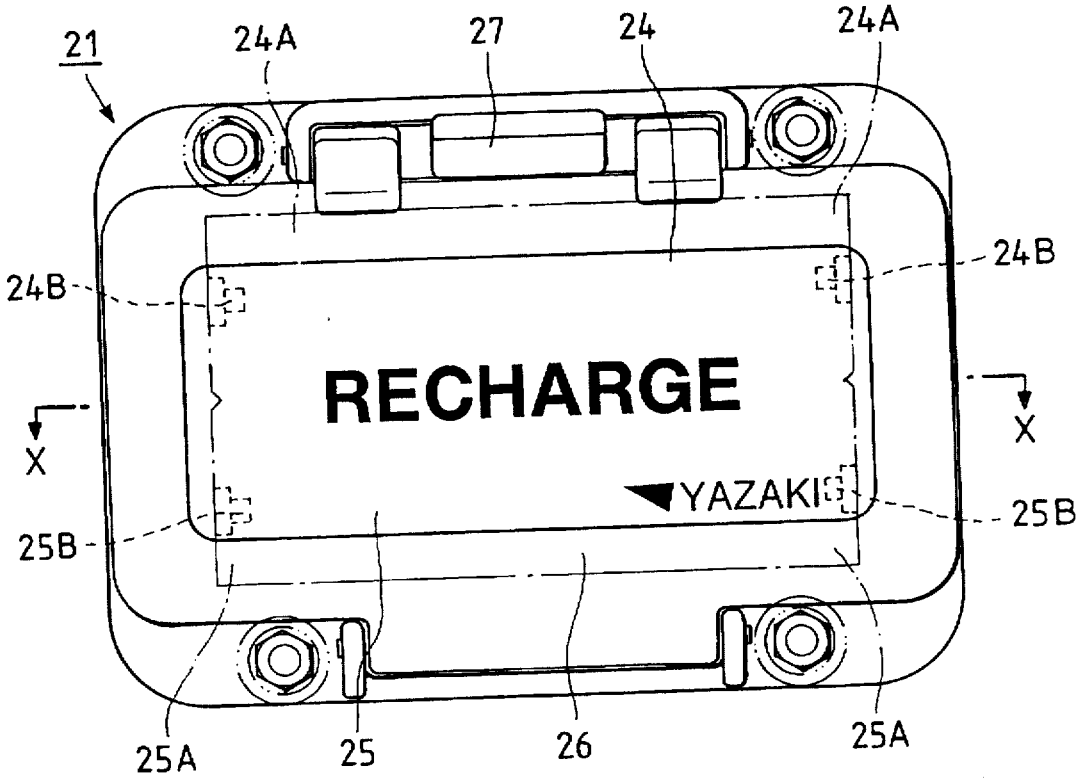
FIG. 5 is a front-elevational view of a second connector of FIG. 4.
Figure 6:
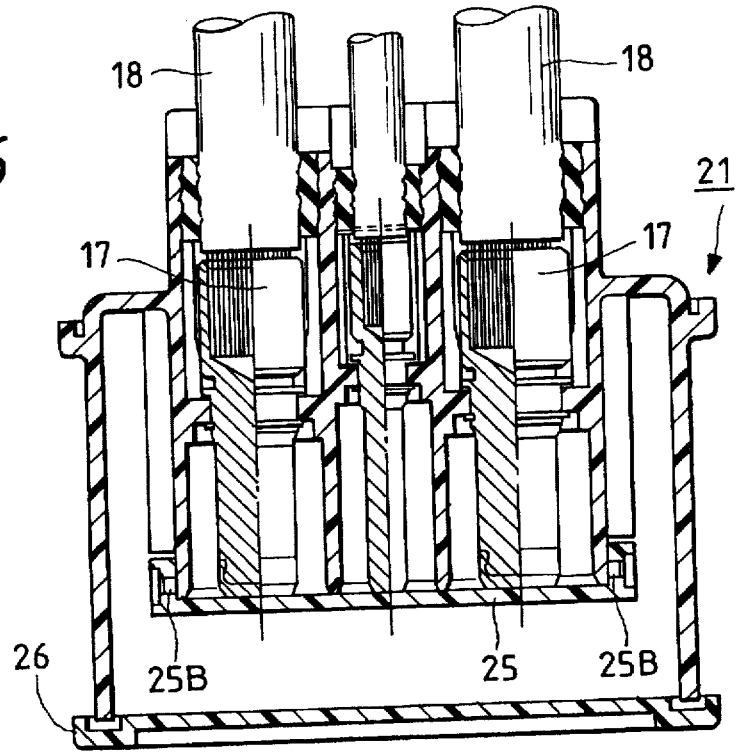
FIG. 6 is a cross-sectional view taken along the line X—X of FIG. 5.

The second connector 21 has a rectangular parallelepipedic shape, and is closed by an openable cover 26 as shown in FIG. 5 which is a front-elevational view, and this cover 26 is held in its closed position by a lock portion 27. FIG. 6 is a cross-sectional view taken along the line X—X of FIG. 5.

In FIG. 4, the second connector 21 has a fitting hood portion 22 extending forwardly, and this fitting hood portion 22 is slightly smaller in size than an inner surface of a housing 2A of the first connector 2. The fitting hood portion 22 can be inserted into the first connector 2 in sliding contact with the inner surface of the housing 2A. When the second connector 21 is fitted in the first connector 2, front end portions 22A and 22B of the fitting hood portion 22 abut respectively against a front surface portion 3A of the upper end of the upper shutter 3 of the first connector 2 and a front surface portion 4A of a lower end of the lower shutter 4.

The second terminals 17 each having a wire 18 connected thereto are received in a support hood portion 28 which is disposed inwardly of the fitting hood portion 22, and extends forwardly.

A upper shutter 24 of a rectangular shape is mounted by pins 24B on upper portions of opposite side walls of the support hood portion 28 at a front end thereof so as to be pivotally moved outwardly (right in the drawings). A lower shutter 25 of a rectangular shape is mounted by pins 25B on lower portions of the opposite side walls of the support hood portion 28 at the front end thereof so as to be pivotally moved outwardly (right in the drawings).

The upper and lower shutters 24 and 25 forms a pair, and are urged toward the inner side of the second connector 21 (that is, to the left in the drawings) by coil springs (not shown). The two shutters 24 and 25 in their closed positions close the second terminals 17, so that the second terminals 17 are not exposed.

As is clear from the above construction, pivotal-movement drive portions for the upper and lower shutters 24 and 25, which include the pins 24B and 25B, are covered by the fitting hood portion 22.

A front surface of the upper end of the upper shutter 24 defines a flat front surface portion 24A, and when an external force directed toward the inner side of the second connector 21 acts on this front surface portion 24A, the upper shutter 24 is pivotally moved outwardly (right in the drawings) about the pins 24B against the bias of the coil spring. Similarly, a front surface of the lower end of the lower shutter 25 defines a flat front surface portion 25B, and when an external force directed toward the inner side of the second connector 21 acts on this front surface portion 25A, the lower shutter is pivotally moved outwardly (right in the drawings) about the pins 25B against the bias of the coil spring.

An upper shutter-receiving groove 23A and a lower shutter-receiving groove 23B are formed between the fitting hood portion 22 and the support hood portion 28. When the two connectors are fitted together, the upper shutter-receiving groove 23A receives the upper shutter 3 of the first connector 2, and the lower shutter-receiving groove 23B receives the lower shutter 4 of the first connector 2.

The operation of this embodiment will now be described with reference to FIGS. 4 and 7 to 9.

When the first and second connectors 2 and 21 is not fitted together, the first connector 2 is closed by the pair of upper and lower shutters 3 and 4.

With respect to the second connector 21, the cover 26 is held in its closed position by the lock portion 27, and the second connector 21 is closed by the pair of upper and lower shutters 24 and 25 which are dispose inwardly of the cover 26.

Therefore, in the first and second connectors 2 and 21, the protection against dust, the protection of the terminals and the prevention of an electric shock to the surroundings are sufficiently achieved.

Figure 7:
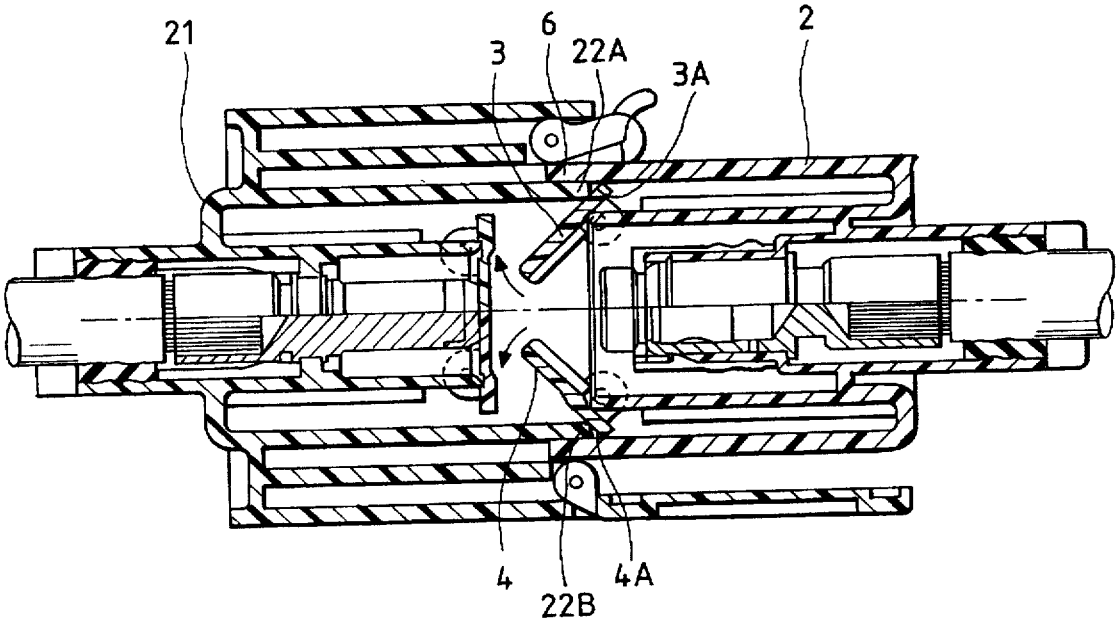
FIG. 7 is a cross-sectional view showing the process of the fitting operation of the connector with the shutter mechanism shown in FIG. 4.

In this condition, first, the lock portion 27 is released, and the cover 26 of the second connector 21 is opened. Then, the first and second connectors 2 and 21 are moved toward each other to be fitted together. As a result, the front end portion 22A of the fitting hood portion 22 of the second connector 21 abuts against the front surface portion 3A of the upper end of the upper shutter 3 of the first connector 2 to urge the front surface portion 3A against the bias of the coil spring, as shown in FIG. 7. Similarly, the front end portion 22B of the fitting hood portion 22 abuts against the front surface portion 4A of the lower end of the lower shutter 4 of the first connector 2 to urge the front surface portion 4A against the bias of the coil spring.

As a result, the pair of shutters 3 and 4 are pivotally moved away from each other about the respective pins 3B and 4B. Namely, the upper shutter 3 is pivotally moved clockwise (in the drawings) whereas the lower shutter 4 is pivotally moved counterclockwise, so that the first terminals 7 are opened. As a result, the front portion of the first connector 2 is opened.

Figure 8:
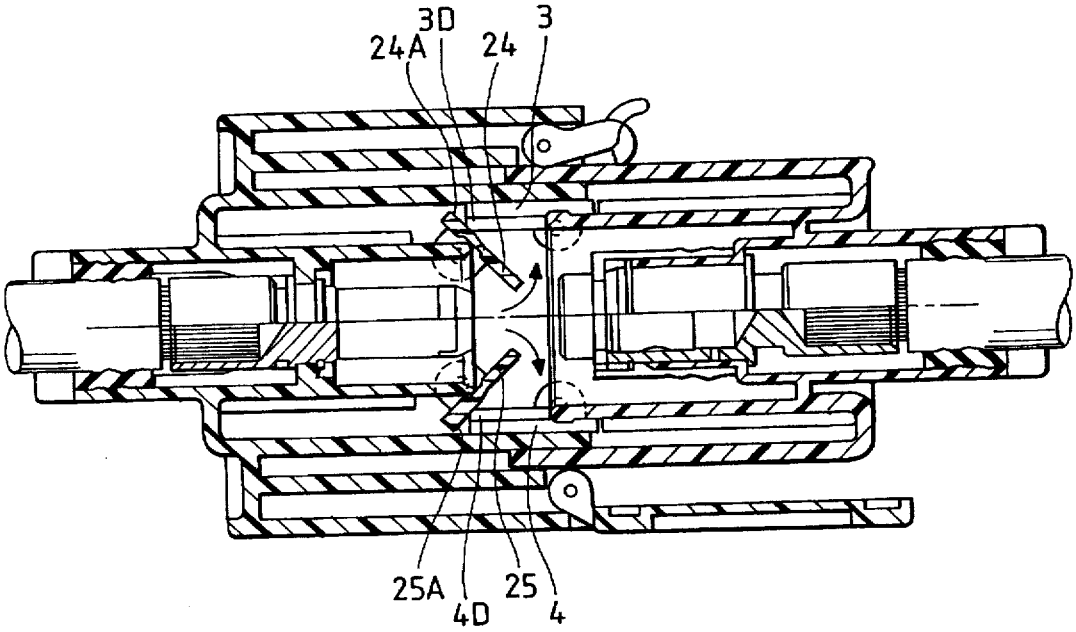
FIG. 8 is a cross-sectional view showing the process of the fitting operation of the connector with the shutter mechanism shown in FIG. 4.

In this condition, when the first connector 2 is further moved toward the rear end of the second connector 21, and hence is inserted deeper into the second connector 21, the upper shutter 3 is pivotally moved into contact with the inner surface of the fitting hood portion 22, as shown in FIG. 8. At this time, the distal end 3D of the upper shutter is brought into engagement with the front surface portion 24A of the upper end of the upper shutter 24 of the second connector 21 to urge this front surface portion 24A against the bias of the coil spring. Similarly, the distal end 4D of the lower shutter is brought into engagement with the front surface portion 25A of the lower end of the lower shutter 25 of the second connector 21 to urge this front surface portion 25A against the bias of the coil spring.

As a result, the pair of upper and lower shutters 24 and 25 are pivotally moved away from each other about the respective pins 24B and 25B. Namely, the upper shutter 24 is pivotally moved counterclockwise (in the drawings) whereas the lower shutter 25 is pivotally moved clockwise, thereby opening the second terminals 17. Thus, the front portion of the second connector 21 is opened.

Figure 9:
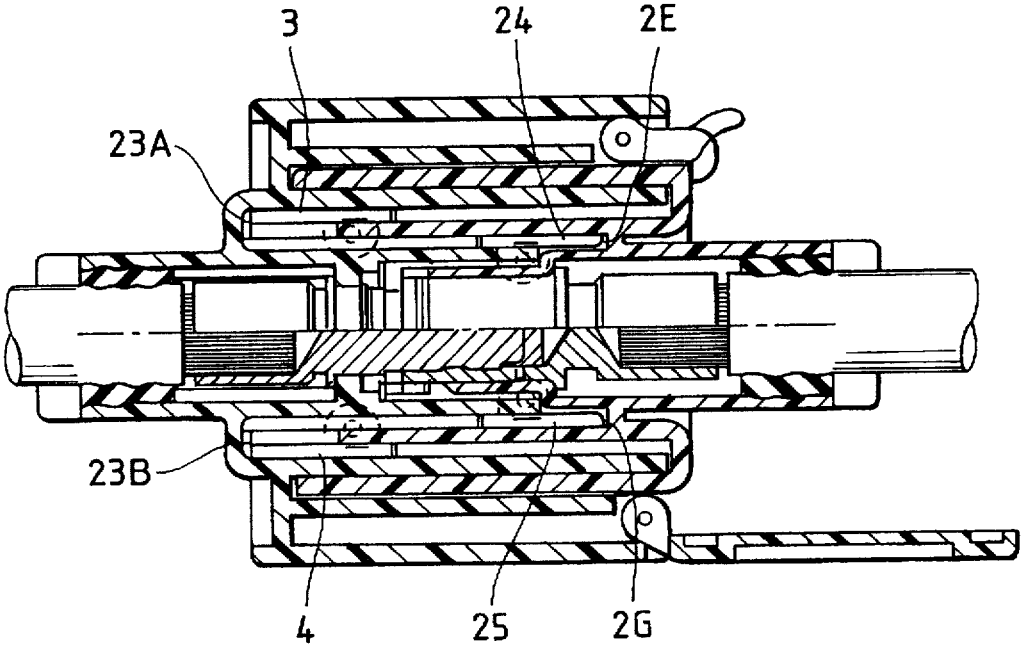
FIG. 9 is a cross-sectional view showing the connector of FIG. 4 with the shutter mechanism in its fully-fitted condition.
Figure 10:
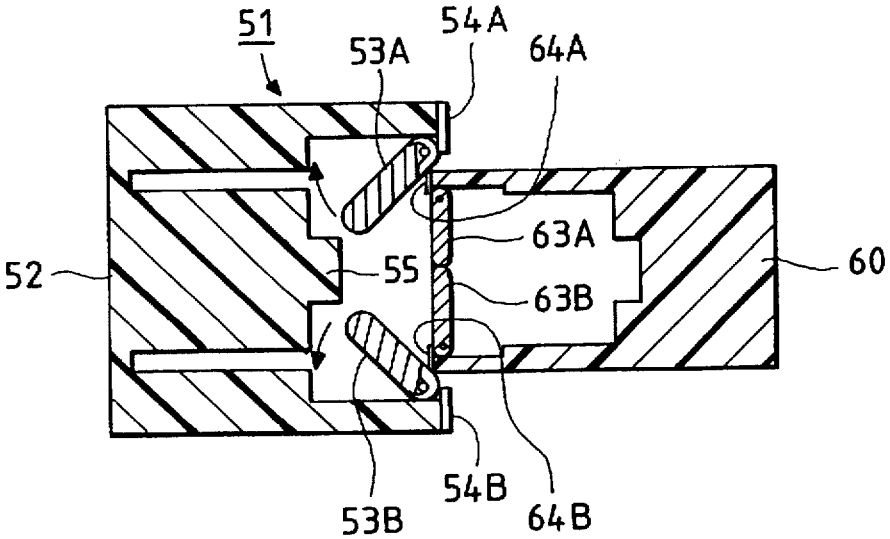
FIG. 10 PRIOR ART
FIG. 10 is a cross-sectional view of a conventional connector with a shutter mechanism.

When the first connector 2 is further inserted deeper, the upper and lower shutters 3 and 4 of the first connector 2 are received respectively in the upper shutter-receiving groove 23A and the lower shutter-receiving groove 23*b* of the second connector 21, as shown in FIG. 9.

The upper and lower shutters 24 and 25 of the second connector 21 are received respectively in the upper shutter-receiving groove 2E and the lower shutter-receiving groove 2G of the first connector 2.

At this time, the second terminals 17 are connected to the first terminals 7, respectively, so that the wires 18 are electrically connected to the wires 7, respectively.

Thus, in this embodiment, the pair of shutters 3 and 4 of the first connector 2 are pivotally moved to pivotally move the pair of shutters 24 and 25 of the second connector 21, respectively. With this construction, a specially-designed opening projection as used in the conventional construction does not need to be provided, and the overall length of the connector can be reduced, thus achieving a compact design.

In this embodiment, because of the provision of the cover 26, the second connector 21 has the double closure construction by which the terminals are prevented from being exposed. As is clear from FIG. 5, in the case where the connector is used in an electric car, this connector can be suitably used as a charging connector mounted on a car body. Even if the cover 26 is left opened, the shutters 24 and 25 will not be accidentally opened by contact from the exterior since the pivotal-movement drive portions thereof are covered by the fitting hood portion 22.

In this embodiment, although each pair of upper and lower shutters can be opened upwardly and downwardly, respectively, from the center position, the invention is not limited to such a construction. For example, there can be provided a pair of right and left shutters which can be opened right and left, respectively, from the center position.

In the above embodiment, although the shutter is divided into the two portions, the invention is not limited to such a construction, and the shutter may be divided into more than two portions.

As described above, in the connector of the invention with the shutter mechanism, one connector is provided with the shutters which are opened outwardly upon application of an external force to the front surface portions thereof, and the other connector is provided with the front end portions for respectively urging these front surface portions of the shutters. Therefore, only when the two connectors are fitted together, the shutters are pivotally moved outwardly to be opened, thereby exposing the terminals in the connectors, so that the terminals in the one connectors are connected respectively to the terminals in the other connector. Therefore, the protection against dust, the protection of the terminals and the prevention of an electric shock are achieved.

In another form of the invention, each of the two connectors is provided with the shutters which are opened outwardly upon application of an external force to the front surface portions thereof. Therefore, the size of the connector can be reduced in the axial direction, thus achieving a compact design, and besides the protection against dust, the protection of the terminals and the prevention of an electric shock are achieved.

What is claimed is:

1. A connector with a shutter mechanism wherein said first connector further includes a hood portion covering a pivotal-movement drive portion of said shutter.

* * * * *

UNITED STATES PATENT AND TRADEMARK OFFICE

CERTIFICATE OF CORRECTION

PATENT NO. : 5,716,224

DATED : February 10,1998

INVENTOR(S) : Satoki Masuda et al.

It is certified that error appears in the above-identified patent and that said Letters Patent is hereby corrected as shown below:

Column 10,lines 17-19 should be deleted and replace with the following:

1. A connector with a shutter mechanism comprising a first connector and a second connector which are fitted to each other to be electrically connected;

wherein said first connector [further] includes a first housing having a first terminal receiving chamber, a shutter attached to said first housing and pivotally moved outward upon application of an external force to a front surface portion of said shutter, and a hood portion covering a pivotal-movement drive portion of said shutter; and wherein said second connector includes a second housing having a second terminal receiving chamber, and a support hood surrounding said second housing and extending forwardly thereof, said support hood urging said front surface portion of said shutter of said first connector when said two connectors are fitted to each other to cause said pivotal outward movement of said shutter.

Signed and Sealed this

Thirteenth Day of July, 1999

*Attest:*

*Attesting Officer*

Q. TODD DICKINSON

*Acting Commissioner of Patents and Trademarks*